US006741960B2

(12) United States Patent
Kim et al.

(10) Patent No.: US 6,741,960 B2
(45) Date of Patent: May 25, 2004

(54) HARMONIC-NOISE SPEECH CODING ALGORITHM AND CODER USING CEPSTRUM ANALYSIS METHOD

(75) Inventors: Hyoung Jung Kim, Taejon (KR); In Sung Lee, Taejon (KR); Jong Hark Kim, Chungju (KR); Man Ho Park, Taejon (KR); Byung Sik Yoon, Taejon (KR); Song In Choi, Taejon (KR); Dae Sik Kim, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 439 days.

(21) Appl. No.: 09/751,302

(22) Filed: Dec. 28, 2000

(65) Prior Publication Data

US 2002/0052736 A1 May 2, 2002

(30) Foreign Application Priority Data

Sep. 19, 2000 (KR) ..... 2000-54960

(51) Int. Cl.[7] ..... G10C 19/02
(52) U.S. Cl. ..... 704/219; 704/230
(58) Field of Search ..... 704/200, 208, 704/219, 220, 221, 225, 226, 230

(56) References Cited

U.S. PATENT DOCUMENTS 3,649,765 A * 3/1972 Rabiner et al. ..... 704/209
4,219,695 A * 8/1980 Wilkes et al. ..... 704/217
5,749,065 A * 5/1998 Nishiguchi et al. ..... 704/200.1
5,774,837 A 6/1998 Yeldener et al. ..... 704/208
5,848,387 A * 12/1998 Nishiguchi et al. ..... 704/214
5,909,663 A * 6/1999 Iijima et al. ..... 704/226
6,289,309 B1 * 9/2001 deVries ..... 704/233
6,496,797 B1 * 12/2002 Redkov et al. ..... 704/220

OTHER PUBLICATIONS

C. Laflamme et al., "*Harmonic–Stochastic Excitation (HSX) Speech Coding Below 4 KBIT/S*", IEEE, 1996. pp. 204–207.
Eric W.M. Yu et al., "*Variable Bit Rate MBELP Speech Coding Via V/UV Distribution Dependent Spectral Quantization*", IEEE, 1997. pp. 1607–1610.
Masayuki Nishiguchi et al., "*Harmonic and Noise Coding of LPC Residuals with Classified Vector Quantization*", IEEE, 1995. pp. 484–487.

* cited by examiner

*Primary Examiner*—Daniel Abebe
(74) *Attorney, Agent, or Firm*—Seed IP Law Group PLLC

(57) ABSTRACT

The present invention relates to a harmonic-noise speech coder and coding algorithm of the mixed signal of voiced/unvoiced sound using harmonic model. The harmonic-noise speech coder comprises a noise spectral estimating means for coding the noise component by predicting the spectral by LPC analysis method after separating the noise, which is unvoiced sound component from the inputted LPC residual signal using cepstrum. And more improved speech quality can be obtained by analyzing noise effectively using the noise spectral model predicted through cepstrum-LPC analysis method of the mixed signal of voiced/unvoiced sound to the existing harmonic model and then coding the signal.

5 Claims, 3 Drawing Sheets

HARMONIC-NOISE SPEECH CODING ALGORITHM AND CODER USING CEPSTRUM ANALYSIS METHOD

TECHNICAL FIELD

The present invention relates to a speech coding and more particularly to the speech coder and coding method using harmonic-noise speech coding algorithm capable of achieving more improved speech quality by using cepstrum analysis method and LPC (Linear Prediction Coefficient) analysis method for the mixed signal of voiced/unvoiced sound which is not represented well in the generally used harmonic coding algorithm.

BACKGROUND OF THE INVENTION

As harmonic model is generally based on sinusoidal analysis and synthesis in the low rate speech coder, noise component with non-stagnant characteristic is not represented well. Therefore, the method for modeling noise component observed in the spectrum of real speech signal has been required.

In order to meet these demands, the research for the harmonic speech coding model such as MELP (Mixed Excitation Linear Prediction) algorithm or MBE (Mixed Band Excitation) algorithm which are known as guaranteeing good speech quality, has been progressed, in which the characteristic of said algorithms is that speech can be observed by dividing the speech into each band and then analyzing it.

However, said algorithms analyze with fixed bandwidth the sound in which voiced/unvoiced sound signal is multiply mixed. And due to the binary decision structure, which is deciding voiced/unvoiced sound at each band, also have limitation on effective representation. And particularly, in the case that voiced/unvoiced sounds are mixed simultaneously or the mixed signal is distributed on the band border, there is a disadvantage that the spectral distortion is occurred.

These disadvantages are caused by using the signal modeling method utilizing only the frequency peak value of the harmonic model in the mixed signal of voiced/unvoiced sound. These cases are caused by insufficient representation of the mixed signal of voiced/unvoiced sound of the low rate model. Recently, in order to solve these disadvantages, the studies on the coding methods for the mixed signal of voiced/unvoiced sound have been actively progressed.

The object of coding for mixed signal of voiced/unvoiced sound is to represent effectively voiced sound spectral part and unvoiced sound spectral part in frequency domain. And there are two coding methods in recent analysis method. The first coding method is dividing into two parts of voiced/unvoiced bands after defining frequency transitional point and the second coding method is differing mixing level of voice/unvoiced sound during synthesis after defining probability value of voiced sound from total spectral information.

As an example of the second coding method, there is U.S. Pat. No. 5,774,837 entitled "Speech Coding System And Method Using Voicing Probability Determination" written by Suat Yeldener and Joseph Gerard Aguilar. The patent described the technology which, in order to analyze and synthesize the mixed signal of voiced/unvoiced sound, analyzes the spectral of voiced sound and modified linear prediction parameter of unvoiced sound and by using the analyzed results synthesizes the mixed signal according to the degree of the probability value of the voiced sound computed from the pitch and parameter which are extracted from the spectrum of the inputted speech signal.

However, above mentioned prior art or technologies extract unvoiced sound by dividing spectral of the mixed signal of voiced/unvoiced sound into two sections and as the analysis and synthesis of the in putted speech signal are based on the probability value, it is impossible to do sound analysis and synthesis effectively through real spectral values of all sections.

SUMMARY OF THE INVENTION

According to a first aspect of the present invention, a harmonic-noise speech coder of the mixed signal of voiced/unvoiced sound using harmonic model is provided. The harmonic-noise coder comprises a noise spectral estimating means for coding the noise component by predicting the spectral by LPC analysis method after separating the noise component which is unvoiced sound component from the inputted LPC residual signal using cepstrum.

Also, according to a second aspect of the present invention, a harmonic-noise speech coding method of the mixed signal of voiced/unvoiced sound includes the following step: A harmonic coding step for coding voiced sound out of the mixed signal; And noise coding step for coding unvoiced sound out of the mixed signal. Preferably, the noise coding step is composed of a cepstrum analyzing step for extracting noise spectral envelope by cepstrum analyzing the mixed signal and an LPC analyzing step for extracting noise spectral envelope information from the extracted spectrum.

BRIEF DESCRIPTION OF THE DRAWINGS

The embodiments of the present invention will be explained with reference to the accompanying drawings, in which.

DETAILED DESCRIPTION OF THE INVENTION

Referring to accompanied drawings, other advantages and effects of the present invention can be more clearly understood through desirably executable examples of the coders being explained.

As described above, the present invention is related to a noise spectral estimator combining ceptrum analysis method and LPC analysis method in order to code the mixed signal of voiced/unvoiced sound and harmonic-noise speech coding combined with harmonic model.

Simply referencing the coding method according to the present invention, the noise spectral is estimated by LPC analysis method after separating the noise region using cepstrum. The estimated noise spectral is parameterized into LP coefficients.

For the mixed signal of voiced/unvoiced sound, the voiced sound uses harmonic coder and the unvoiced sound uses ceptrum LPC noise coder.

The synthesized excitation signal is obtained by adding the voiced sound which is synthesized by harmonic synthesizer and unvoiced sound component, noise which is synthesized through LPC synthesis filter.

Figure 1:
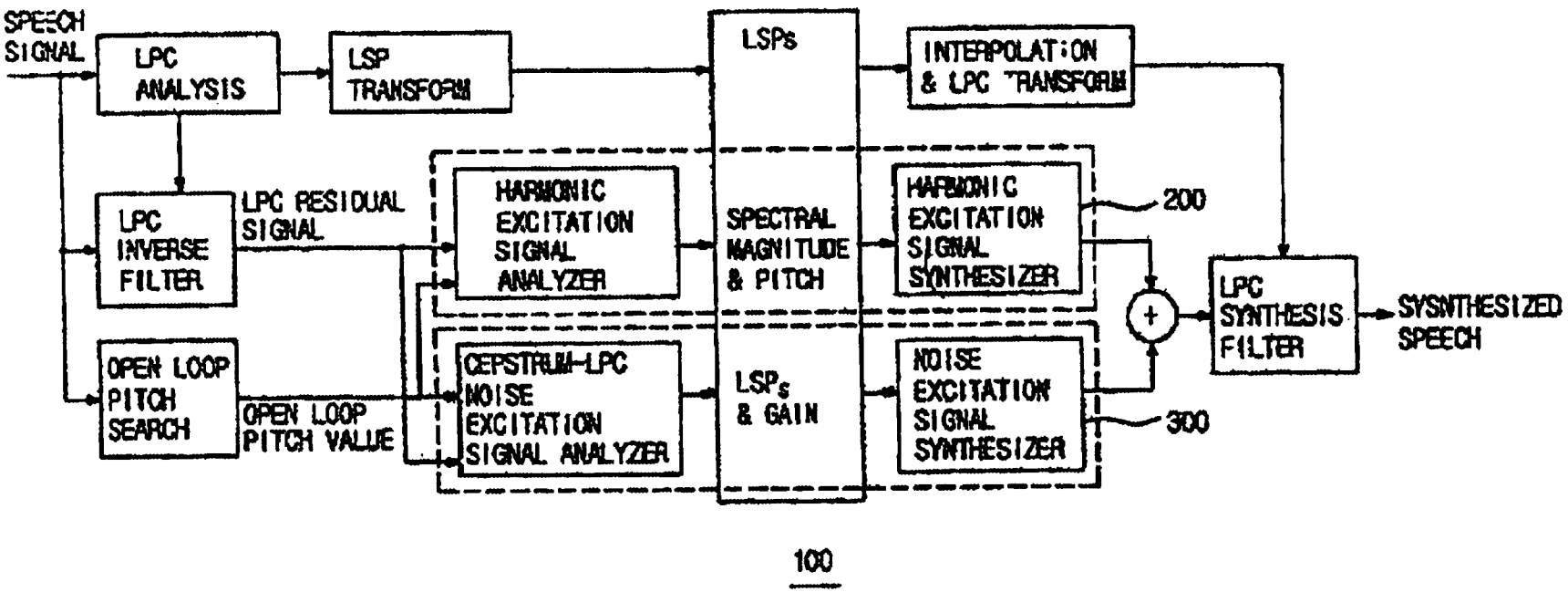
FIG. 1 is a drawing illustrating the total block diagram of the harmonic-noise speech coder 100.

First, referring to FIG. 1, the total block diagram of the harmonic-noise speech coder 100 is illustrated.

As shown in FIG. 1, the coder 100 according to the present invention is composed of a harmonic coder 200 and a noise coder 300 in order to code the mixed signal of voiced/unvoiced sound. The LPC residual signals become the input signal of said harmonic coder 200 and said noise coder 300 respectively.

Especially, in order to estimate the noise spectral, uses ceptrum and LPC analysis method while the open loop pitch value being input of said noise coder 300. The open loop pitch value is used as common input to said harmonic coder 200.

The other components illustrated in FIG. 1 will be referred through the detailed description of the present invention.

Figure 2:
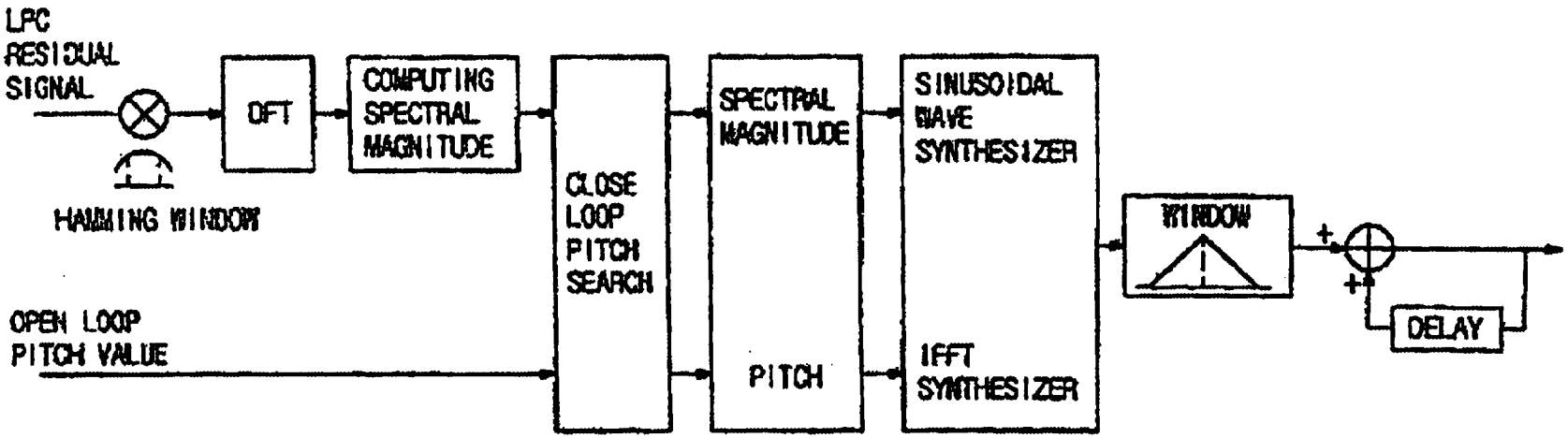
FIG. 2 is a drawing illustrating the block diagram of the harmonic coder 200 illustrated in said FIG. 1 for voiced sound component.

Referring to FIG. 2, the block diagram of the harmonic coder 200 illustrated in said FIG. 1 for voiced sound component is illustrated.

The general coding procedure of said harmonic coder 200 used in the coding method according to the present invention is described as follows. First, the LPC residual signal, the input signal is passed through the hamming window and the corrected pitch value and harmonic magnitude are extracted through the analysis of the spectrum of frequency domain. The synthesis procedure is progressed to the step for synthesizing the representative waveform of each frame obtained from Inverse Fast Fourier Transform (IFFT) waveform synthesis by overlap/add method.

From now on the extracting method of each parameter is described through more detailed description of fundamental theory.

The object of the harmonic model is LPC residual signal and the finally extracted parameters are the magnitude of the spectrum and the close loop pitch value $\omega_o$.

More concretely, the representation of the excitation signal, namely the LPC residual signal, passes detailed coding procedure on the basis of sinusoidal waveform model as following Equation 1.

$$s(n) = \sum_{l=1}^{L} A_l \cos(\omega_l n = \varphi_l) \quad \text{[Equation 1]}$$

Where $A_1$ and $\psi_1$ represent magnitude and phase of sinusoidal wave component with frequency $\omega_1$ respectively. L represents the number of sinusoidal wave. As the harmonic portion includes most of the information of the speech signal in the excitation signal of the voiced sound section, it can be approximated using appropriate spectral fundamental model.

Following Equation 2 represents the approximated model with linear phase synthesis.

$$s^k(n) = \sum_{l=1}^{L_k} A_l^k \cos(l\omega_0^k n + \varphi^k(l, \omega_0^k, n) + \Phi_l^k) \quad \text{[Equation 2]}$$

Where k and $L_k$ represent frame number and the number of harmonics of each frame respectively, $\omega_o$ represents the angular frequency of the pitch, and $\Phi^k_l$ represents the discrete phase of the $k^{th}$ frame and the $l^{th}$ harmonic.

The $A^k_l$ representing the magnitude of the $k_{th}$ frame harmonic is the information transmitted to the decoder, and by making the value being applied 256 DFT (Discrete Fourier Transform) of the Hamming Window to be reference model. The spectral and pitch parameter value making the value of the following Equation 3 to be minimized is determined by closed loop searching method.

$$e_1 = \sum_{l=a_l}^{b_l} (|X(i)| - |A_l||B(i)|)^2 \quad \text{[Equation 3]}$$

$$A_l = \frac{\sum_{j=a_l}^{b_l} |X(j)||B(j)|}{\sum_{j=a_l}^{b_l} |B(j)|^2}$$

Where, X(j) and B(j) represent the DFT value of the original LPC residual signal and the DFT value of the 256-point hamming window respectively, and $a_m$ and $b_m$ represent the DFT indexes of the start and end the $m^{th}$ harmonic. X(i) means the spectral reference model.

Each parameter analyzed is used for synthesis and the method of the phase synthesis method uses general linear phase $\psi^k(l,\omega_0^{k-1},n)$ synthesis method like following Equation 4.

$$\varphi^k(l, \omega_0, n) = \varphi^{k-1}(l, \omega_0^{k-1}, n) + \frac{l(\omega_0^{k-1} + \omega_0^k)}{2} n \quad \text{[Equation 4]}$$

The linear phase is obtained by linearly interpolating the fundamental frequency according to the time of the previous fame and the present frame. Generally, the hearing sense system of man is assumed to be non-sensitive to the linear phase and to permit inaccurate or totally different discrete phase while phase continuity is preserved.

These perceptible characteristics of a man are important condition for the continuity of the harmonic model in low rate coding method. Therefore, the synthesis phase can substitute the measured phase.

These harmonic synthesis models can be implemented by the existing IFFT synthesis method and the procedure is as follows.

In order to synthesize the reference waveform, the harmonic magnitudes are extracted through inverse quantization procedure in the spectral parameter.

The phase information corresponding to each harmonic magnitude is made by using the linear phase synthesis method and then the reference waveform is made through 128-point IFFT. As the reference waveform does not include the pitch information, reformed to the circular format and then final excitation signal is obtained by sampling after interpolating to the over-sampling ratio obtained from the pitch period considering the pitch variation.

In order to guarantee the continuity between frames, the start position defined as offset is defined as following Equation 5.

$$ov = \frac{256}{2T_p} = \frac{256/4}{T_p/2} = \frac{64}{l} \quad \text{[Equation 5]}$$

$$P_{av}[n] = \sum_{l=0}^{n}\left(\frac{N-i}{N}ov^{k-1} + \frac{i}{N}ov^{k}\right)$$

$$\omega^{k1}(l) = \omega^{k-1}(\mathrm{mod}(l, 128))$$

$$\omega^{k}(l) = \omega^{k}(\mathrm{mod}(offset + l, 128))$$

$$offset = 128 - \mathrm{mod}(l, 128)$$

Above equations represent over-sampling rate ov and sampling position $P_{ov}[n]$ respectively. Where N, $T_p$, l and k represent frame length, pitch period, number of harmonics and frame number, respectively. L means the number of over-sampled data in order to recover N samples and mod(x, y) returns the residual value after dividing x by y. Also, $w^{rk}(l)$ and $w^{k}(l)$ represent $k^{th}$ circular waveform and the $k^{th}$ reference waveform, respectively.

Figure 3:
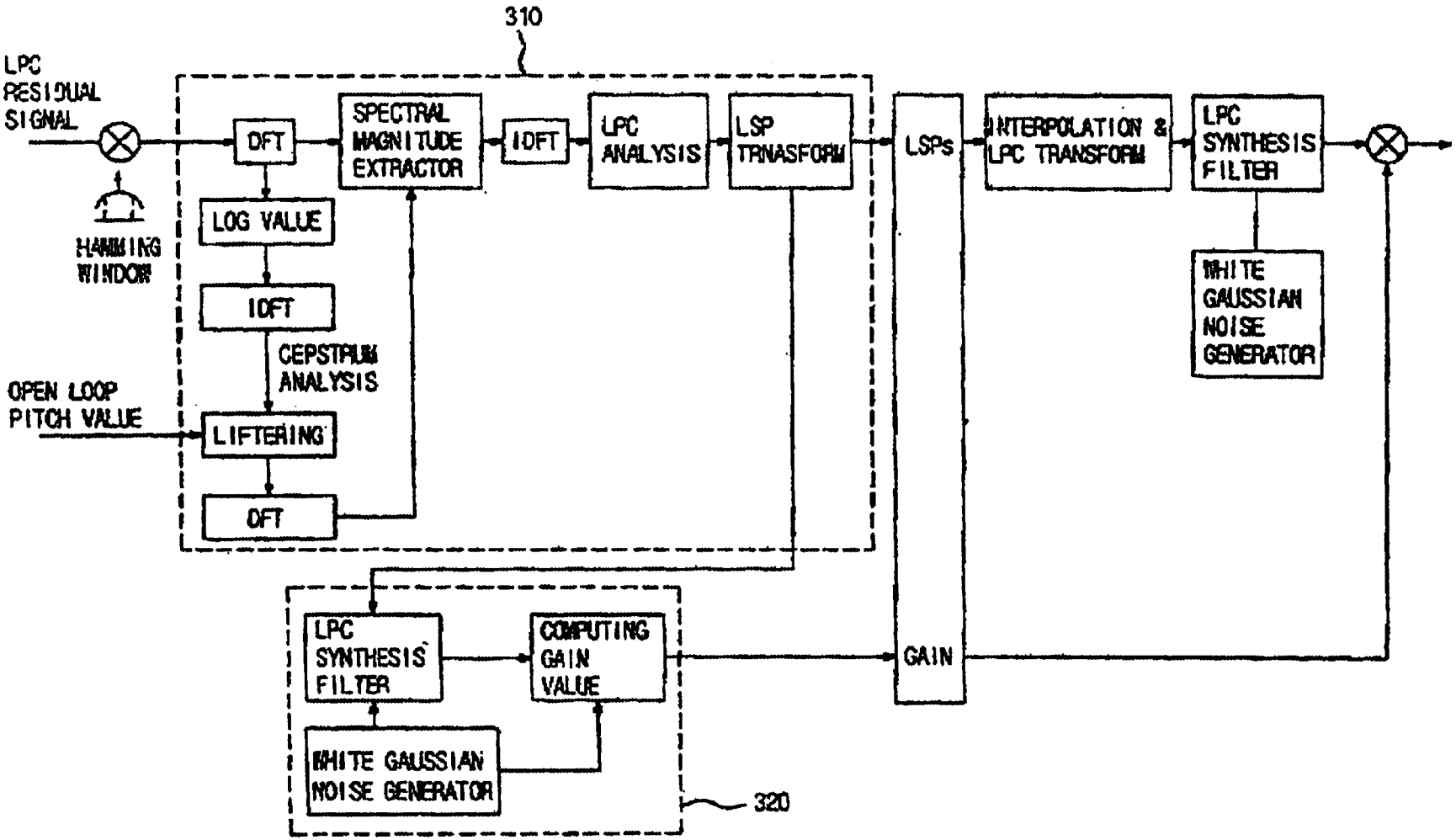
FIG. 3 is a drawing illustrating the all procedures for obtaining LPC parameter through cepstral-LPC noise spectral estimator.

On the other hand, the effective modeling of the noise spectral used in the coding method according to the present invention is composed of the structure predicting noise component using cepstrum and LPC analysis method. Referring to FIG. 3, the procedure is described in detail.

The speech signal can be assumed as the model composed of several filters by analyzing the pronouncing structure of man.

In the desirably executable example according to the present invention the assumption as following Equation 6 is made, in order to obtain the noise region.

$$s(t)=e(t)*\ h(t)=(v(t)+u(t))*\ h(t) \quad \text{[Equation 6]}$$

Where, s(t) is the speech signal, h(t) is the impulse response of vocal track and e(t) is excitation signal. v(t) and u(t) mean the pseudo period and the period portion of the excitation signal, respectively.

As shown in Equation 6, the speech signal can be represented as convolution of the excitation signal and the impulse response of the vocal track. The excitation signal is divided into the periodic signal and aperiodic signal. Herein the periodic signal means the voiceprint pulse train of the pitch period and the aperiodic signal means the noise-like signal by the radiation from lip or the air-flow from lung.

The Equation 6 can be transformed to the spectral region and can be represented as following Equation 7.

$$\begin{aligned} S(\omega) = \ &\geq |S(\omega)e^{j\theta(\omega)}| \quad \text{[Equation 7]} \\ &= (|V(\omega)|e^{j\theta_v(\omega)} + |U(\omega)|e^{j\theta_u(\omega)})\,|H(\omega)|e^{j\theta_k(\omega)} \\ &= (V(\omega) + U(\omega))H(\omega) \end{aligned}$$

Where, S(w), U(w), V(w) and H(w) means the Fourier Transfer Function of s(t), u(t), v(t) and h(t) respectively. From the Equation 7, applying logarithmic arithmetic and IDFT can be represented as following Equation 8 and Equation 9 in order to obtain the cepstral coefficient.

$$\log|S(\omega)|=\log|V(\omega)+U(\omega)|+\log|H(\omega)| \quad \text{[Equation 8]}$$

$$c(t)=IDFT[\log|V(\omega)+U(\omega)|+\log|H(\omega)|] \quad \text{[Equation 9]}$$

The cepstrum obtained from said Equation 9 can concrete the voiced sound portion to three separated domains. The quefrency region, as the neighboring values of the cepstral peak in the pitch period is the portion caused by the harmonic component those can be assumed as the periodic voiced sound component. Also the high quefrency region of the right side of the peak value can be assumed as what caused mainly by noise excitation component. Finally, the low quefrency region of the left side of the peak value can be assumed as the component caused by the vocal track.

Here, the positive and negative magnitude values can be observed by transforming the cepstrum value neighboring the pitch by the harmonic component to the logarithmic spectrum domain after liftering them as many as the number of the experimental samples. The negative magnitude values become the valley portion of the mixed signal.

In reality, the harmonic components out of the spectrum of the mixed signal concentrate on the multiple of the pitch frequency and the noise components are added to the harmonic components in the mixed format. Therefore, while it is difficult to separate the aperiodic components of the neighborhood of the frequencies corresponding to the multiple of the pitch frequency, it is feasible to separate the noise component in the valley portion between the frequencies corresponding to the multiple of the pitch frequencies.

By the reason, the magnitude spectrum of the excitation signal focuses on the negative logarithmic magnitude spectrum of the extracted cepstrum.

In the coding method according to the present invention, the components of the valley portion, which is a part of the noise spectral envelope are extracted by using the cepstrum analysis method. Concretely, the spectral valley portion of the mixed signal is extracted by applying rectangular window as much as the negative region of the logarithmic magnitude extracted in the neighborhood of the pitch period.

Next, the LPC analysis method is applied to the extracted partial noise spectral components in order to predict the noise component in the harmonic region. As this is equal to the method for extracting the spectral envelope of the speech signal, it can be considered as the prediction method for estimating the noise spectral within the harmonic region.

Concretely, the extracted noise spectrum is transformed to the signal information of time axis by applying the IDFT and then the $6^{th}$ LPC analysis procedure is performed in order to extract the spectral information. The extracted $6^{th}$ LPC parameter is converted to the LSP parameter in order to increase the quantization effectiveness. Herein the $6^{th}$ is the empirical value according to the research result of the present invention, which considered the degree of dispersion of the allocation bit and the noise spectrum component according to the low rate and the phase of the input signal is used as the phase in IDFT.

The total procedure for obtaining the LPC parameter through the cepstral-LPC noise spectral predictor is illustrated in FIG. 3.

The cepstral-LPC noise spectral predictor shown in FIG. 3 according to present invention comprises a noise coding section 310 for extracting to code unvoiced sound among the mixed signals inputted, and a gain calculating section 320 for calculating a gain value of noise component.

From the structure shown in FIG. 3, the buzz sound following low rate can be reduced and the coefficient obtained from the LPC analysis method what is called all-poll fitting can be transformed to the LSP. As various researches about said LSP is being developed now, in the coding method according to the present invention the effective quantization structure can be achieved by selecting appropriate method out of the LSP methods.

Meanwhile, the procedure for computing the gain value of the noise component excepting the information representing the spectral envelope is needed and the gain value is obtained from the ratio of the input signal and the LPC synthesis signal which is using the inversely quantizied $6^{th}$ LPC value and the gaussian noise as input.

Herein, the gaussian noise is equal to the generation pattern of the gaussian noise of the speech synthesis stage and the quantization to the logarithmic scale is appropriate.

The noise spectral parameters obtained by the method are transmitted to the speech synthesis stage with the gain parameter and the spectral magnitude parameter of the harmonic coder representing the periodic component and synthesized by the overlap/add method.

The gaussian noise is generated in order to obtain the synthesis noise, the noise spectral information is added using the transmitted LPC coefficient and gain value and additionally the linear interpolation of the gain and LSP is performed.

The LPC synthesis structure can do time region synthesis by passing the LPC filter by simply making the white gaussian noise to be input without an additional phase accordance procedure between frames. Herein the gain value can be scaled considering the quantization and spectral distortion and when implementing a noise remover the LSP value can be adjusted according to the estimated value of the background noise.

Although the present invention was described on the basis of preferably executable examples, these executable examples do not limit the present invention but exemplify. Also, it will be appreciated by those skilled in the art that changes and variations in the embodiments herein can be made without departing from the spirit and scope of the present invention as defined by the following claims.

What is claimed is:

1. A harmonic-noise speech coder of the mixed signal of voiced/unvoiced sound using harmonic model, which comprises a noise spectral estimating means for coding the noise component by predicting the spectral by LPC analysis method after separating the noise component that is unvoiced sound component from the inputted LPC residual signal using cepstrum said noise spectral estimating means comprising a logarithmic value extracting means for extracting the negative logarithmic value of the extracted cepstrum in said cepstrum analysis; an amplitude extracting means for extracting the spectral valley portion of the mixed signal corresponding to said extracted negative logarithmic value of the spectrum region; an LPC analyzing means for extracting the spectral information by applying IDFT to said extracted noise spectral; an LSP transforming means for transforming said extracted LPC parameter to LSP parameter; and a gain computing means for computing the gain value of the noise component.

2. The harmonic-noise speech coder according to claim 1, wherein said gain computing means is composed of white gaussian noise generator and an LPC filter and said LPC filter filters the output signal of said white gaussian noise generator and the LPC parameter extracted from said LPC analyzing means.

3. A harmonic-noise speech coding method of the mixed signal of voiced/unvoiced sound, comprising the steps of:

a harmonic coding step for coding voiced sound out of said mixed signal; and a noise coding step for coding unvoiced sound out of said mixed signal, wherein said noise coding step is composed of cepstrum analyzing step for extracting noise spectral envelope by cepstrum analyzing said mixed signal and an LPC analyzing step for extracting noise spectral information from said extracted spectrum, said cepstrum analyzing step comprising a first step for obtaining cepstrum by applying IDFT after transforming said mixed signal to spectral region by applying DTF and computing the logarithmic value of said spectral region; and a second step for extracting only the negative region of the logarithmic value spectrum after extracting the cepstrum value neighboring the pitch of the extracted harmonic component as fixed sample number and transforming to logarithmic spectrum region.

4. The harmonic-noise speech coding method according to claim 3, wherein said LPC analyzing step comprises a first transforming step for transforming the extracted noise spectrum to the signal information of time axis by applying IDFT; and a second transforming step for transforming the LPC parameter extracted by the $6^{th}$ LPC analysis to the LSP parameter in order to obtain spectral information.

5. The harmonic-noise speech coding method according to either claim 3, wherein said noise coding step further comprises a gain generating step for synthesizing said extracted spectral envelope by making white gaussian noise to be input.

* * * * *